US010563939B1

(12) United States Patent
Oglesby

(10) Patent No.: US 10,563,939 B1
(45) Date of Patent: Feb. 18, 2020

(54) FORWARD ASSIST FOR A FIREARM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/188,662

(22) Filed: Nov. 13, 2018

Related U.S. Application Data

(60) Provisional application No. 62/585,475, filed on Nov. 13, 2017.

(51) Int. Cl.
*F41A 3/38* (2006.01)

(52) U.S. Cl.
CPC ..... *F41A 3/38* (2013.01)

(58) Field of Classification Search
CPC ..... F41A 3/36; F41A 3/38; F41A 3/42; F41A 3/64; F41A 3/66; F41A 3/68; F41A 3/70; F41A 3/72; F41A 9/39
USPC ..... 89/1.4
See application file for complete search history.

(56) References Cited

U.S. PATENT DOCUMENTS 2,225,583 A 12/1940 Blizard
3,236,155 A * 2/1966 Sturtevant ..... F41A 3/18 89/199
3,442,173 A 5/1969 Muller
4,422,254 A 12/1983 McQueen
4,667,429 A 5/1987 Perazzi
4,681,020 A 7/1987 Polanecky
6,305,114 B1 10/2001 Saltz
7,313,996 B2 1/2008 Werner
8,276,502 B1 10/2012 Wright
8,806,790 B1 8/2014 Huang et al.
D723,646 S 3/2015 Keezer
9,003,948 B2 4/2015 Brown
9,587,897 B1 3/2017 Huang et al.
2004/0144245 A1 7/2004 Wonisch et al.
2005/0229462 A1 10/2005 McGarry
2005/0241470 A1 11/2005 Hochstrate et al.
2008/0302235 A1 12/2008 Lauck
2010/0000396 A1* 1/2010 Brown ..... F41A 3/72 89/1.4
2011/0252957 A1* 10/2011 Overstreet ..... F41A 3/12 89/128
2012/0260793 A1* 10/2012 Gomez ..... F41A 3/66 89/191.01
2013/0111796 A1 5/2013 Dionne et al.
2015/0362270 A1* 12/2015 Stewart ..... F41A 3/72 42/16
2018/0087860 A1* 3/2018 Sullivan ..... F41A 17/46

* cited by examiner

*Primary Examiner* — Bret Hayes
(74) *Attorney, Agent, or Firm* — Shaddock Law Group, PC

(57) ABSTRACT

A forward assist that includes at least some of a plunger; a partially rotatable, spring biased pawl extending from a portion of the plunger; a projection extending from a first end of the plunger; and at least one head having a recess formed in at least a portion of the, wherein the head recess is mateable with the projection of the plunger, and wherein the head is secured to a first end of the plunger via interaction of the projection and the head recess.

16 Claims, 16 Drawing Sheets

FORWARD ASSIST FOR A FIREARM

CROSS-REFERENCE TO RELATED APPLICATIONS

This patent application claims the benefit of U.S. Patent Application Ser. No. 62/585,475, filed Nov. 13, 2017, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE PRESENT DISCLOSURE

1. Field of the Present Disclosure

The present disclosure relates generally to the field of firearms. More specifically, the present disclosure relates to forward assists for firearms.

2. Description of Related Art

Typically, the forward assist on a firearm is a spring biased, plunger-type device found commonly on AR-15, M16, or M4 style rifles. The forward assist includes a pawl that pivotably extends from the main body of the forward assist.

The forward assist is located such that a rear portion of the forward assist extends from the upper receiver of the firearm and at least a portion of the pawl extends into the upper receiver. If the forward assist is urged forward, relative to the upper receiver, the pawl is urged forward, so as to contact one of a plurality of notches or grooves formed in the bolt carrier, to urge the bolt carrier forward, ensuring that the bolt is in a fully forward or locked position.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

While forward assists are available having heads or pads of various shapes, removal and replacement of a forward assist requires removal a roll pin through the upper receiver of the firearm and removal and replacement of the entire forward assist. Because of the difficulty in replacing the forward assist, many users choose to keep the originally installed forward assist or have a new forward assist installed by a gunsmith.

The features and elements of the presently disclosed forward assists provide various features and design elements that overcome the shortcomings of known forward assists and provide improved forward assists. Furthermore, using the features and elements of the presently disclosed forward assist, the main body of the forward assist can be installed in the upper receiver and the head or head of the forward assist can be easily replaced with a head or pad having a desired shape, by the user.

In various exemplary, nonlimiting embodiments, the presently disclosed forward assists comprise a plunger; a partially rotatable, spring biased pawl extending from a portion of the plunger; a projection extending from a first end of the plunger; and at least one head having a recess formed in at least a portion of the, wherein the head recess is mateable with the projection of the plunger, and wherein the head is secured to a first end of the plunger via interaction of the projection and the head recess.

In certain exemplary embodiments, the projection of the plunger is a dovetail projection.

In certain exemplary embodiments, the head recess in the head is a dovetail recess.

In certain exemplary embodiments, the head recess extends through at least a portion of the head or optionally extends through opposing sides of the head.

In various exemplary, nonlimiting embodiments, the presently disclosed forward assists further comprise a substantially cylindrical collar, wherein the collar is spring biased to cover at least a portion of the plunger and a portion of the head, when the collar is in an engaged position.

In certain exemplary embodiments, when the collar is in a disengaged position, the collar does not cover a collar recess portion of the head.

In certain exemplary embodiments, a plurality of the heads is provided.

In certain exemplary embodiments, the head is further secured to the projection of the plunger via a head retaining screw attaching or coupling the head to the plunger.

In certain exemplary embodiments, the head is further secured to the projection of the plunger via a spring biased detent extending from the plunger at least partially into the head.

In various exemplary, nonlimiting embodiments, the presently disclosed forward assists comprise a plunger; a partially rotatable, spring biased pawl extending from a portion of the plunger; a projection extending from a first end of the plunger; a substantially cylindrical collar, wherein the collar is slidably positioned relative to the plunger, and wherein the collar is spring biased to cover at least a portion of the plunger and a portion of the head when the collar is in an engaged position; and at least one head having a head recess formed in at least a portion of the head, wherein the head recess is mateable with the projection of the plunger, and wherein the head is secured to a first end of the plunger via interaction of the projection and the head recess.

In certain exemplary embodiments, the projection of the plunger is a dovetail projection.

In certain exemplary embodiments, the head recess in the head is a dovetail recess.

In certain exemplary embodiments, the head recess extends through opposing sides of the head.

In certain exemplary embodiments, when the collar is in a disengaged position, the collar does not cover a collar recess portion formed in the head.

In certain exemplary embodiments, the head is further secured to the projection of the plunger via a head retaining screw attaching or coupling the head to the plunger.

In certain exemplary embodiments, the head is further secured to the projection of the plunger via a spring biased detent extending from the plunger at least partially into the head.

In various exemplary, nonlimiting embodiments, the presently disclosed forward assists comprise a plunger; a partially rotatable, spring biased pawl extending from a portion of the plunger; a recess formed in a first end of the plunger; a substantially cylindrical collar, wherein the collar is slidably positioned relative to the plunger, and wherein the collar is spring biased to cover at least a portion of the plunger and a portion of the head when the collar is in an engaged position; and at least one head having a projection extending from a second end of the head, wherein the projection is mateable with the head recess of the plunger, and wherein the head is secured to a first end of the plunger via interaction of the head recess and the projection.

In certain exemplary embodiments, the head recess extends through at least a portion of the plunger or optionally extends through opposing sides of the plunger.

Accordingly, the present disclosure provides improved forward assists for firearms.

The present disclosure separately and optionally provides a forward assist that can be retrofitted to an existing firearm.

The present disclosure separately and optionally provides a forward assist with a head that can be easily installed by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed embodiments of the present disclosure are provided herein. However, it is to be understood that the disclosed embodiments are merely exemplary of the present disclosure that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
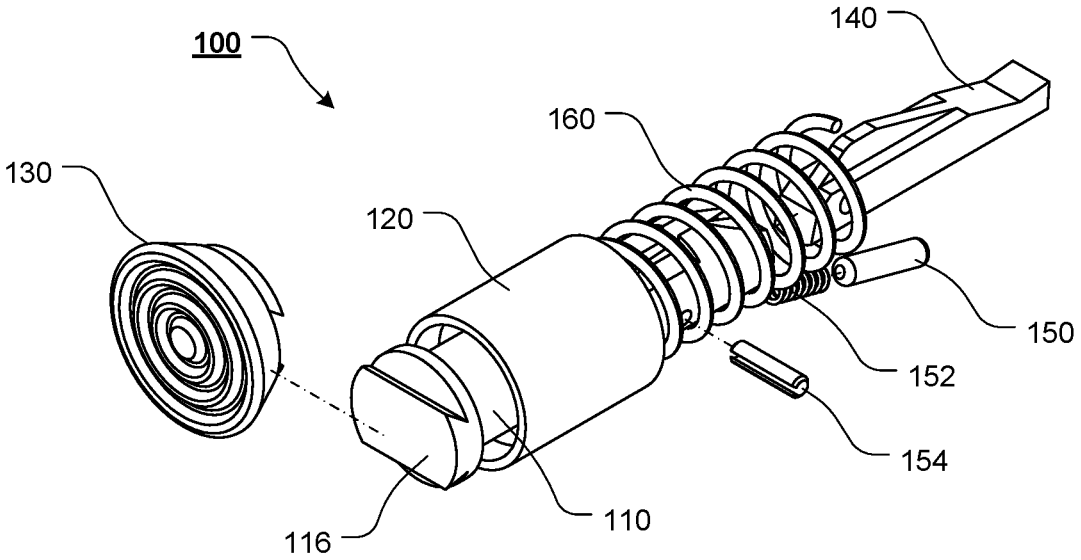
FIG. 1 illustrates an exploded view of certain components or elements of an exemplary embodiment of a forward assist, according to the present disclosure.

For simplicity and clarification, the design factors and operating principles of the forward assists according to the present disclosure are explained with reference to various exemplary embodiments of a forward assist according to the present disclosure. The basic explanation of the design factors and operating principles of the forward assists is applicable for the understanding, design, and operation of the forward assists of the present disclosure. It should be appreciated that the forward assist can be adapted to many applications where a forward assist can be used.

It should also be appreciated that the terms "firearm" and "forward assist" are used for basic explanation and understanding of the operation of the systems, methods, and apparatuses of the present disclosure. Therefore, the terms "firearm" and "forward assist" are not to be construed as limiting the systems, methods, and apparatuses of the present disclosure.

For simplicity and clarification, the various embodiments of the forward assists of the present disclosure will be described as being used in connection with a firearm, and, more specifically, an AR-15, M16, or M4 style rifle. However, it should be appreciated that these are merely exemplary embodiments of the forward assists and are not to be construed as limiting this disclosure. Thus, the forward assists of the present disclosure may be utilized in connection with any firearm or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-15 illustrate certain elements and/or aspects of various components of an exemplary embodiment of a forward assist 100, according to the present disclosure, FIGS. 16-25 illustrate certain elements and/or aspects of an exemplary embodiment of various components of an forward assist 100, according to the present disclosure, and FIGS. 26-34 illustrate certain elements and/or aspects of various components of an exemplary embodiment of a forward assist 100, according to the present disclosure.

In certain illustrative, non-limiting embodiments of the present disclosure, as illustrated in FIGS. 1-15, the forward assist 100 comprises at least some of a plunger 110, a collar 120, and a head 130.

As illustrated in FIGS. 1-11, the forward assist 100 comprises a substantially cylindrical plunger body 111 that extends from a first end 112 to a second end 113. A pawl 140 is attached or coupled, via, for example, a roll pin 154, to the plunger 110. Thus, the pawl 140 is at least partially rotatable relative to the plunger 110. The pawl 140 extends from a portion of the second end 113 of the plunger 110 and a pawl detent spring 152, positioned within a pawl detent recess 119, acts on a pawl detent 150, also at least partially positioned within the pawl detent recess 119, to bias the pawl 140 relative to the plunger 110.

A projection 116 extends from the first end 112 of the plunger 110. In various exemplary, nonlimiting embodiments, the projection 116 extends from the first end 112 of the plunger 110 as a dovetail projection 116.

A plunger extension 114 extends from an area of the plunger body 111 proximate the first end 112 of the plunger 110. The plunger extension 114 extends such that an outer diameter of the plunger extension 114 is greater than an outer diameter of an adjacent portion of the plunger body 111. A plunger extension shoulder 115 is formed between the plunger extension 114 and the adjacent portion of the plunger body 111. In various exemplary embodiments, a surface of the plunger extension shoulder 115 extends perpendicular to an outer surface of the adjacent plunger body 111 formed perpendicular to the longitudinal axis, $A_L$, of the plunger 110.

The substantially cylindrical collar 120 extends from a first collar end 121 to a second collar end 122, along a longitudinal axis, $A_L$, of the collar 120. A first collar aperture 123 extends from the first collar end 121 to a first interior collar sidewall 124 of the Interior collar wall 125. A second collar aperture 127 extends from the second collar end 122 to a second interior collar sidewall 128 of the Interior collar wall 125. A collar wall aperture 126 joins the first collar aperture 123 to the second collar aperture 127.

In various exemplary embodiments, a depth of the second collar aperture 127, as defined between the second collar end 122 and a second interior collar sidewall 128 of the Interior collar wall 125, is greater than a depth of the first collar aperture 123, as defined between the first collar end 121 and first interior collar sidewall 124 of the Interior collar wall 125.

A diameter of the collar wall aperture 126 is less than a diameter of the first collar aperture 123 and a diameter of the second collar aperture 127. In various exemplary embodiments, a diameter of the first collar aperture 123 is equal to a diameter of the second collar aperture 127. Alternatively, the diameter of the first collar aperture 123 is greater than or less than the diameter of the second collar aperture 127.

The diameter of the collar wall aperture 126 is such that the plunger 110 can be positioned through the collar wall aperture 126 such that the collar 120 can be repeatably slidable relative to the plunger body 111 and the first interior collar sidewall 124 extends so as to contact or otherwise interact with a surface of the plunger extension shoulder 115, to limit travel of the collar 120 relative to the first end 112 of the plunger 110.

Figure 9:
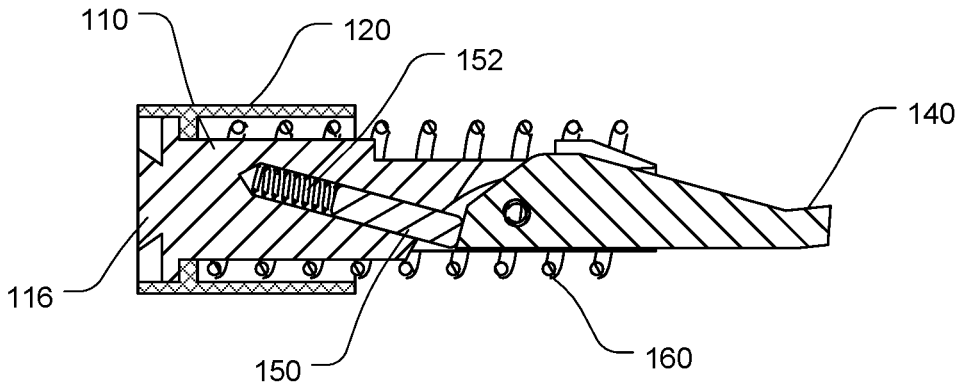
FIG. 9 illustrates a side, cross-sectional view of certain components of an exemplary embodiment of a partially assembled forward assist, wherein the collar is in an engaged or locked position, according to the present disclosure.
Figure 10:
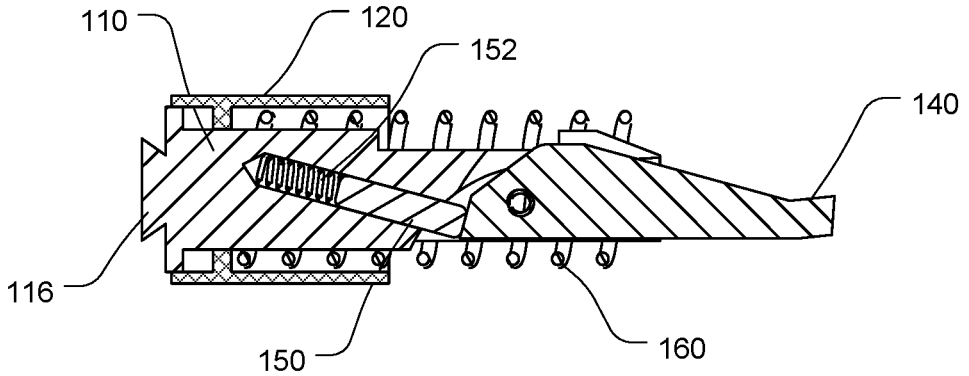
FIG. 10 illustrates a side, cross-sectional view of certain components of an exemplary embodiment of a partially assembled forward assist, wherein the collar is in a retracted or unlocked position, according to the present disclosure.

When the collar 120 is slidably positioned relative to the plunger 110, as illustrated in FIGS. 1 and 9-10, a space between the outer surface of the collar 120 body and the inner surface of the first collar aperture 123 allows an action spring 160 to be at least partially positioned around a portion of the plunger body 111, within the first collar aperture 123. A terminal end of the action spring 160 is abutted against the Interior collar wall 125 of the collar 120.

Figure 11:
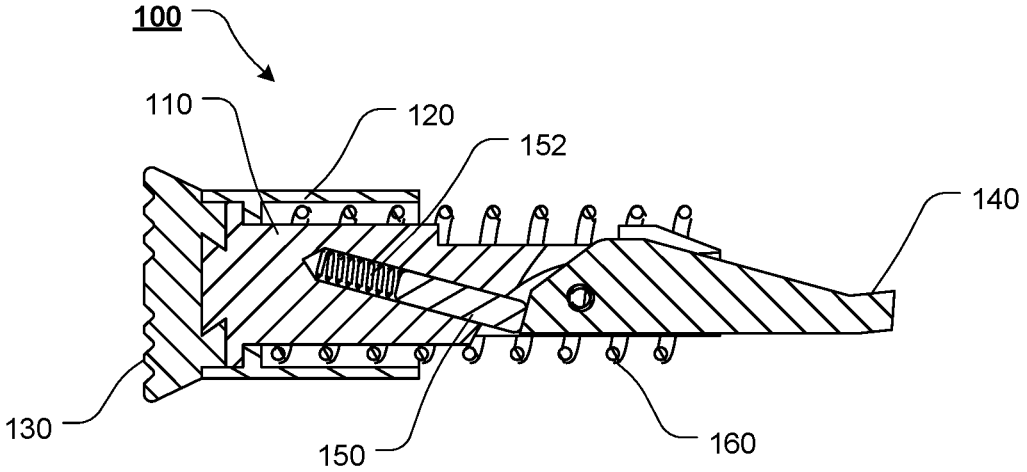
FIG. 11 illustrates a side, cross-sectional view of certain components of an exemplary embodiment of a partially assembled forward assist, wherein a head is installed and the collar is in an engaged or locked position, according to the present disclosure.
Figure 12:
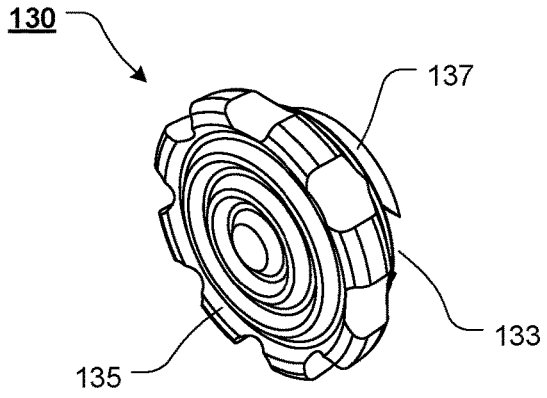
FIG. 12 illustrates a perspective view of an exemplary embodiment of a head, according to the present disclosure.
Figure 13:
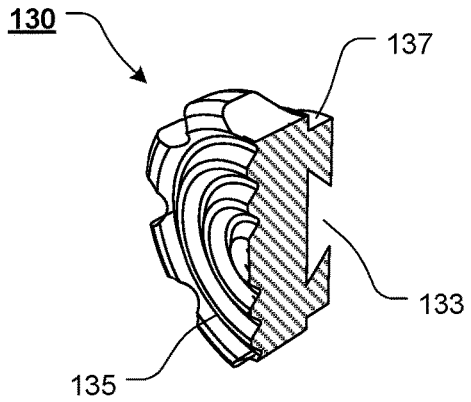
FIG. 13 illustrates a perspective, cross-sectional view of an exemplary embodiment of a head, according to the present disclosure.
Figure 14:
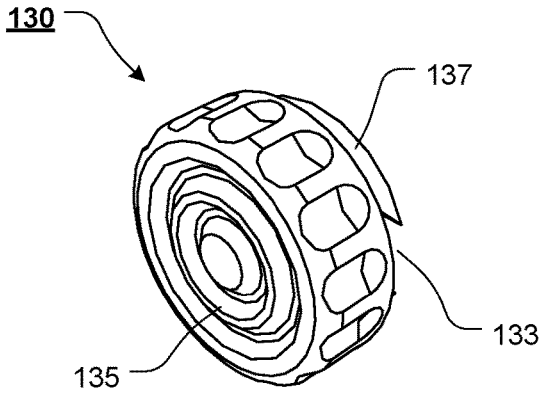
FIG. 14 illustrates a perspective view of an exemplary embodiment of a head, according to the present disclosure.
Figure 15:
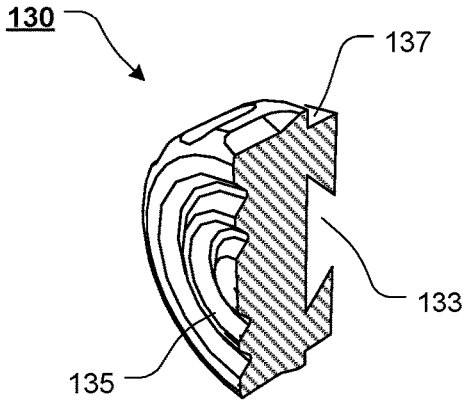
FIG. 15 illustrates a perspective, cross-sectional view of an exemplary embodiment of a head, according to the present disclosure.
Figure 16:
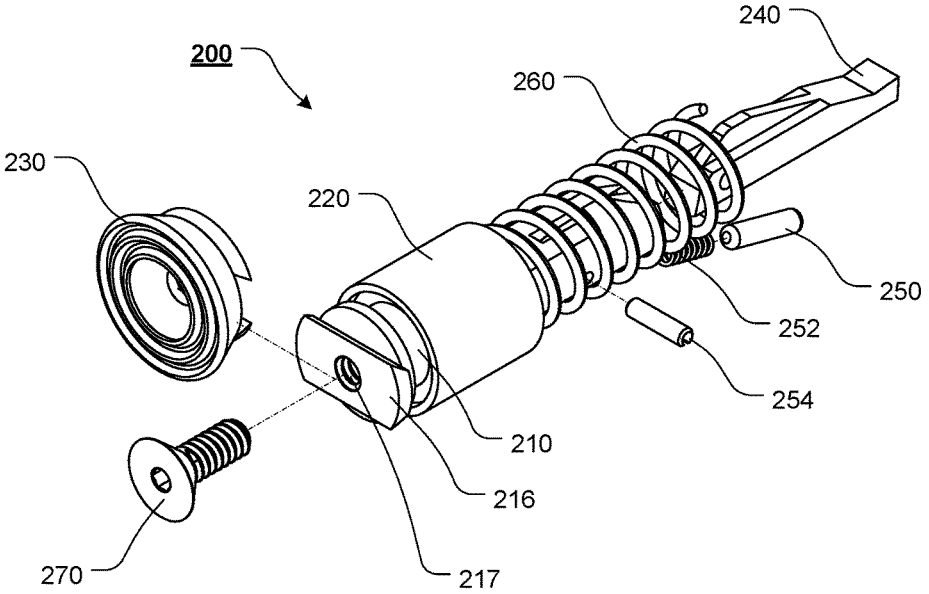
FIG. 16 illustrates an exploded view of certain components or elements of an exemplary embodiment of a forward assist, according to the present disclosure.
Figure 17:
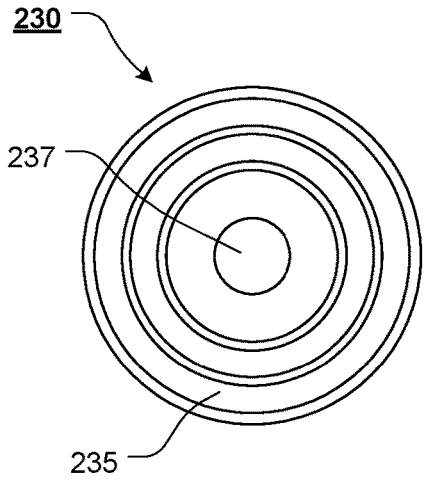
FIG. 17 illustrates a front view of an exemplary embodiment of an exemplary embodiment of a forward assist head, according to the present disclosure.
Figure 18:
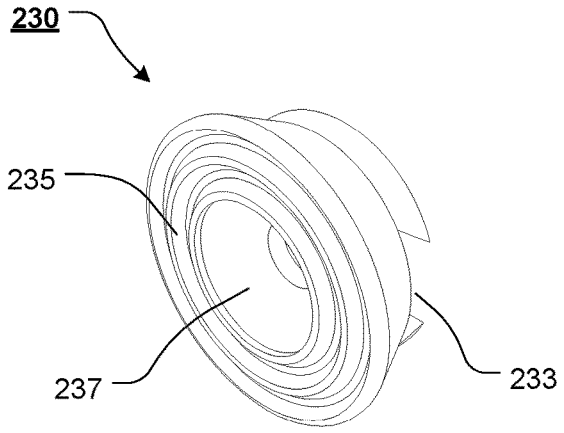
FIG. 18 illustrates an upper, front, perspective view of an exemplary embodiment of a forward assist head, according to the present disclosure.
Figure 19:
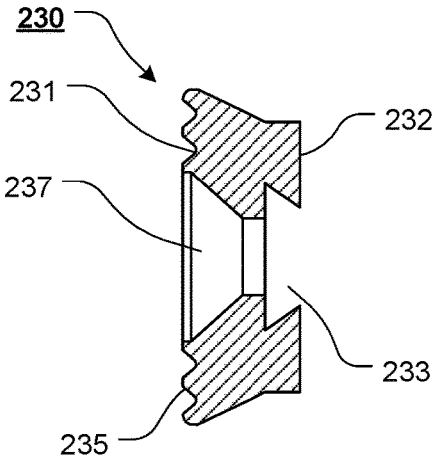
FIG. 19 illustrates a side, cross-sectional view of an exemplary embodiment of a forward assist head, according to the present disclosure.
Figure 20:
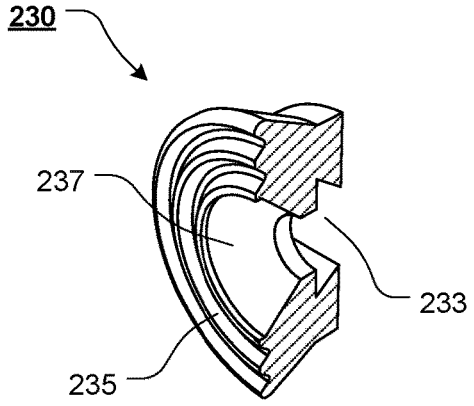
FIG. 20 illustrates a perspective, cross-sectional of an exemplary embodiment of a forward assist head, according to the present disclosure.
Figure 21:
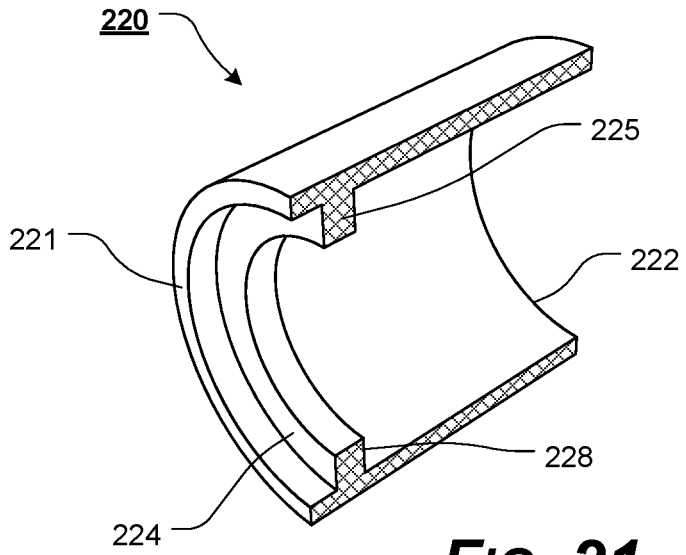
FIG. 21 illustrates a perspective, cross-sectional view of an exemplary embodiment of a collar, according to the present disclosure.
Figure 22:
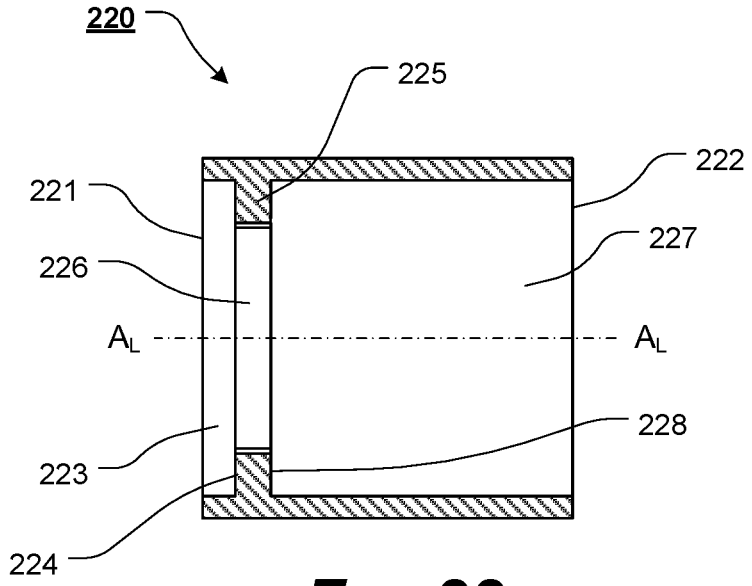
FIG. 22 illustrates a side, cross-sectional view of an exemplary embodiment of a collar, according to the present disclosure.
Figure 23:
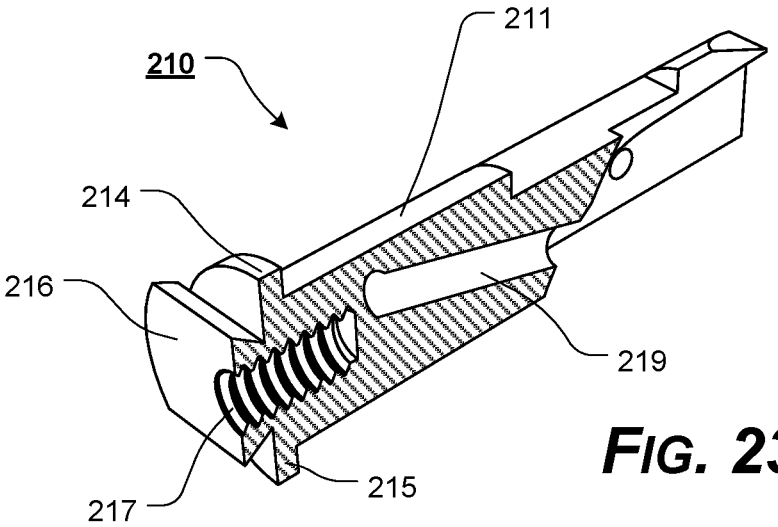
FIG. 23 illustrates a perspective, cross-sectional view of an exemplary embodiment of a plunger, according to the present disclosure.
Figure 24:
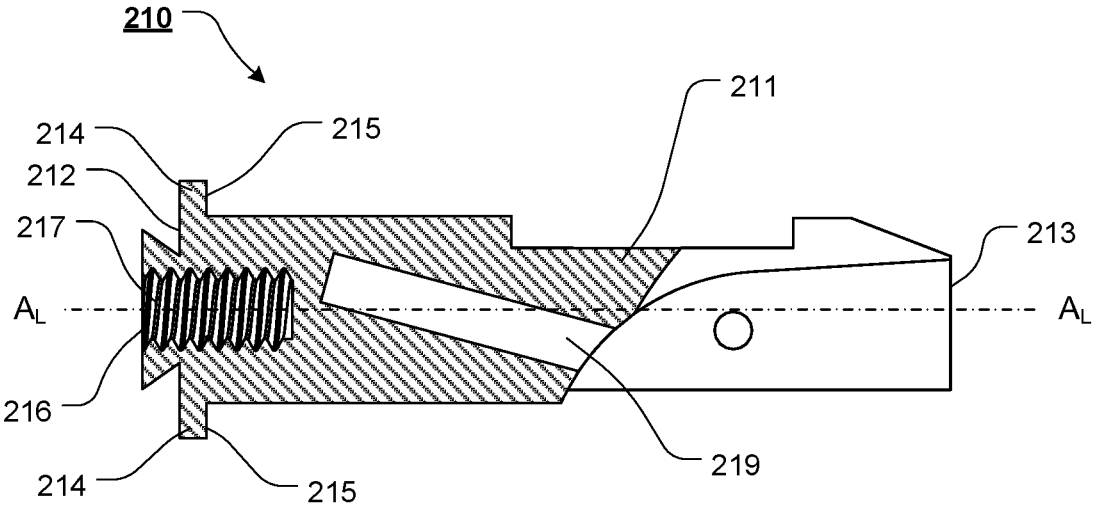
FIG. 24 illustrates a side, cross-sectional view of an exemplary embodiment of a plunger, according to the present disclosure.

In this manner, when the plunger 110 is installed in a firearm or other device, similar to the manner in which a known forward assist 100 is installed, the action spring 160 biases the collar 120 to an engaged or locked position, as illustrated in FIGS. 9 and 11, such that a surface of the Interior collar wall 125 is abutted against a surface of the plunger extension shoulder 115.

However, when the plunger 110 is installed, the collar 120 can be urged toward the second end 113 of the plunger 110, such that the spring bias of the action spring 160 is overcome and the collar 120 can be slidably urged from the engaged or locked position, as illustrated in FIGS. 9 and 11, to the disengaged or unlocked position, as illustrated in FIGS. 1 and/or 10.

Figure 2:
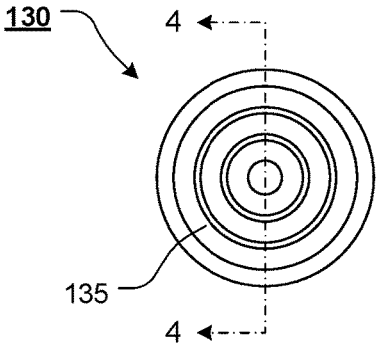
FIG. 2 illustrates a front view of an exemplary embodiment of a forward assist head, according to the present disclosure.
Figure 3:
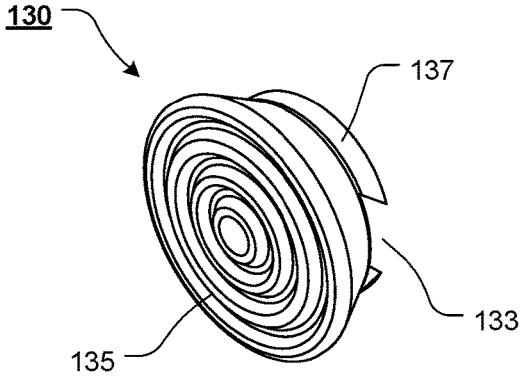
FIG. 3 illustrates an upper, front, perspective view of an exemplary embodiment of a forward assist head, according to the present disclosure.
Figure 4:
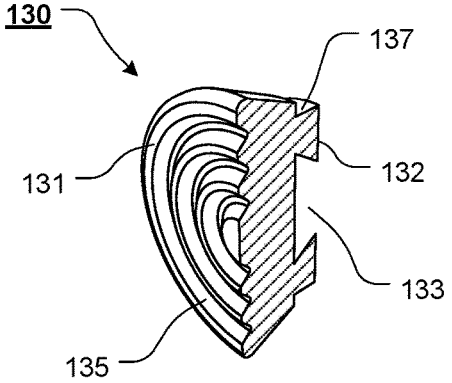
FIG. 4 illustrates a perspective, cross-sectional view taken along line 4-4 of the forward assist of FIG. 2, according to the present disclosure.
Figure 5:
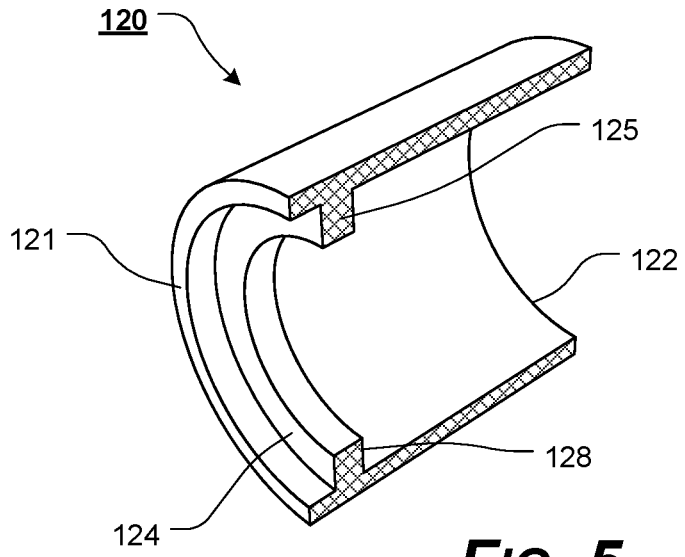
FIG. 5 illustrates a perspective, cross-sectional view of an exemplary embodiment of a collar, according to the present disclosure.
Figure 6:
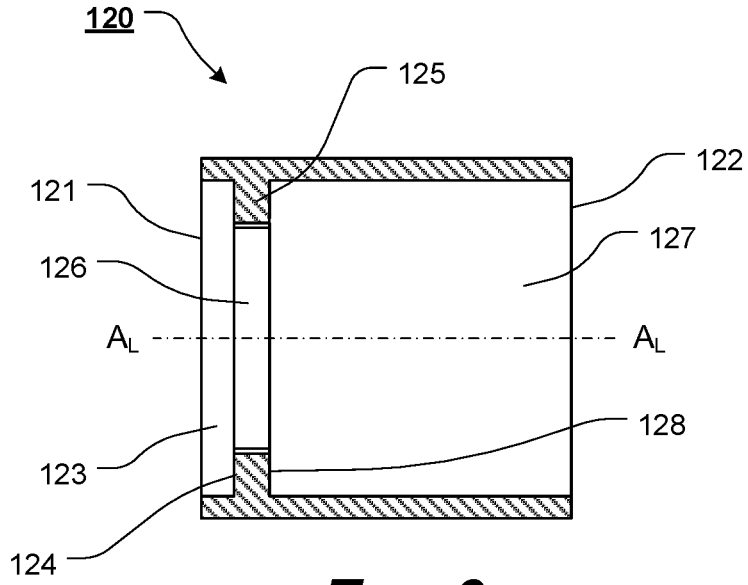
FIG. 6 illustrates a side, cross-sectional view of an exemplary embodiment of a collar, according to the present disclosure.
Figure 7:
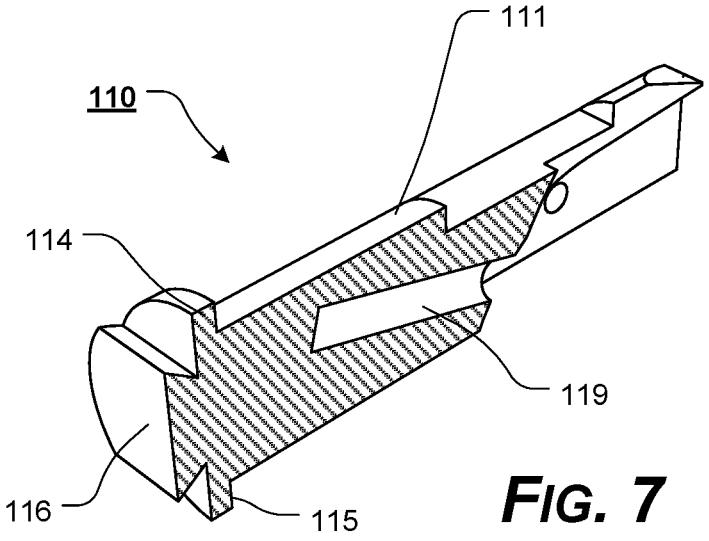
FIG. 7 illustrates a perspective, cross-sectional view of an exemplary embodiment of a plunger, according to the present disclosure.
Figure 8:
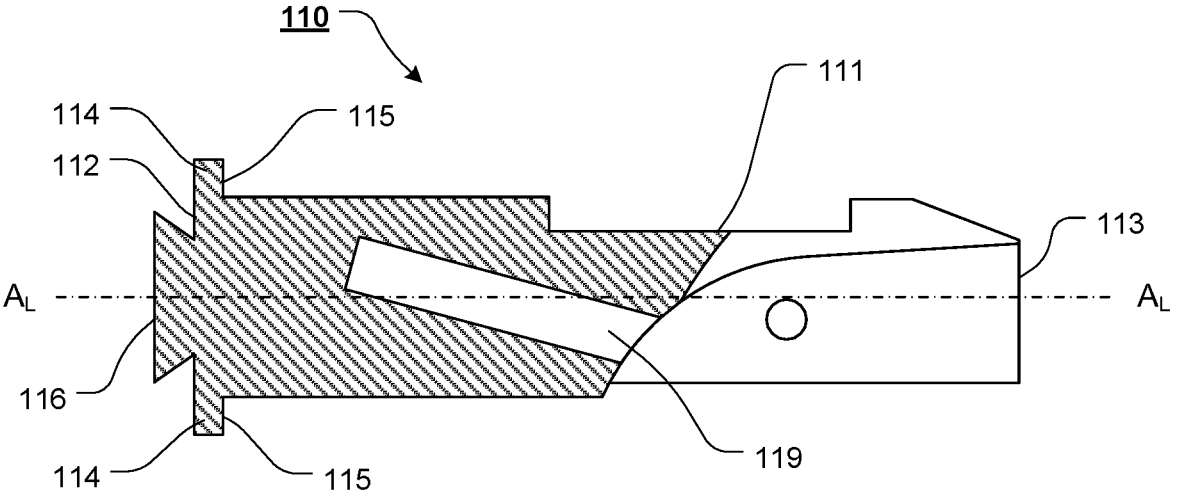
FIG. 8 illustrates a side, cross-sectional view of an exemplary embodiment of a plunger, according to the present disclosure.

FIGS. 2-4 illustrate an exemplary head 130 to be utilized with the plunger 110. As illustrated, the exemplary head 130 includes a head recess 133 formed in at least a portion of a second end 132 of the head 130. The head recess 133 is formed so as to be fully or partially slidably mateable with the projection 116 116 of the plunger 110. In various exemplary embodiments, the head recess 133 is a dovetail head recess 133.

In certain exemplary embodiments, the head recess 133 extends through at least a portion of the head 130. Alternatively, the head recess 133 may extend through opposing sides of the head 130.

At least one collar recess portion 139 portion or collar recess portion 139 is formed in the head 130. The collar recess portion 139 extends from the second end 132 of the head 130 toward the first end 131 of the head 130. An outer diameter of the collar recess portion 139 is such that at least a portion of the collar recess portion 139 portion of the head 130 can be repeatably slidably received within at least a portion of the first collar aperture 123 of the collar 120.

In certain exemplary embodiments, the collar recess portion 139 is a continuous recess around the entire circumference of the head 130. Alternatively, the collar recess portion 139 may comprise one or more recesses formed at desired locations around a portion of the head 130. In each embodiment, the collar recess portion 139 is formed so as to allow at least a portion of the collar recess portion 139 to be received within the first collar aperture 123 of the collar 120.

In various exemplary embodiments, the first end 131 of the head 130 may optionally include a textured pad portion 135 having a surface that includes texturing or other surface preparations for tactile or ornamental purposes. Additionally or alternatively, side portions of the head 130 may optionally include textured portions, recessed portions, or other surface preparations for tactile or ornamental purposes. While the exemplary head 130 illustrated in FIGS. 2-4, showing textured pad portion 135 comprising concentrically formed circles, alternative textured pad portion 135*s* or overall head 130 shapes may be utilized. For example, alternate textured pad portion 135*s* or overall head 130 shapes, such as those illustrated in FIGS. 12-15, may be utilized. Thus, it should be understood that the desired size, shape, and/or texturing of the head 130 is a design choice, based upon the desired functionality and/or ornamental appearance of the head 130 and/or the forward assist 100.

Thus, a plurality of optional head 130*s* can be provided that may each be interchangeably attached or coupled to the plunger 110.

In certain exemplary embodiments, one or more components or elements of forward assist 100 are formed of steel. Alternate materials of construction of one or more components of the forward assist 100 may include one or more of the following: stainless steel, aluminum, titanium, and/or other metals, as well as various alloys, combinations, and/or composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components or elements of the forward assist 100 is a design choice, based upon the desired functionality and/or appearance of the forward assist 100.

A desired head 130 may be attached or coupled to the plunger 110 when the plunger 110 is installed in a firearm or separate from the firearm. During attachment or coupling of an optional head 130, as illustrated in FIGS. 9-11, the collar 120 may initially be spring biased to the engaged or locked position, as illustrated in FIG. 9.

As illustrated most clearly in FIG. 10, to install (or uninstall) a head 130, the collar 120 is urged away from the projection 116 and first end 112 of the plunger 110, so as to overcome any spring bias provided to the collar 120, via the action spring 160. When the collar 120 is urged to the disengaged or unlocked position, the projection 116 is sufficiently exposed so as to allow a head 130 to be slidably attach or coupled to the projection 116, via interaction of the projection 116 and the head recess 133. When the head 130 is appropriately slidably positioned relative to the plunger 110, the collar 120 can be released and the spring bias provided by the action spring 160 urges the collar 120 to return to the engaged or locked position, as illustrated in FIG. 11.

When in the engaged or locked position, at least a portion of the collar recess portion 139 is received within at least a portion of the first collar aperture 123, such that at least a portion of the first collar end 121 extends to cover at least a portion of the collar recess portion 139. When the collar 120 is in the engaged or locked position, lateral or sliding movement of the head 130 is restricted such that the head 130 cannot be slidably removed from the plunger 110. Thus, when the collar 120 is in the engaged or locked position, movement of the head 130 relative to the longitudinal axis of the plunger 110 (forward and backward movement) is restricted by interaction of the projection 116 and the head recess 133, while movement of the head 130 perpendicular to the longitudinal axis of the plunger 110, along the projection 116 (side-to-side movement) is restricted by the interaction of at least a portion of the collar 120 and the collar recess portion 139 of the head 130.

It should be appreciated that while the projection 116 is shown and described as extending from the first end 112 of the plunger 110 and the head recess 133 is shown as extending into the head 130, a projection 116 may extend from the head 130 and a mating recess may be formed in the plunger 110.

A more detailed explanation of the interaction of the forward assist 100 with the components of the firearm or other device, methods for installing the forward assist 100 in a firearm or other device, and/or instructions regarding how to use the forward assist 100, once installed, are not provided herein because such functionality and instructions will be understood by one of ordinary skill in the art. Therefore, it is believed that the level of description provided herein is sufficient to enable one of ordinary skill in the art to understand and practice the method as described.

FIGS. 16-27, illustrate certain elements and/or aspects of an exemplary embodiment of a forward assist 200, according to the presently disclosed systems, methods, and/or apparatuses. As illustrated in FIGS. 16-27, the forward assist 200 comprises at least some of a plunger 210 extending from a first end 212 to a second end 213 and including a projection 216, a plunger extension 214, a plunger extension shoulder 215, a plunger body 211, and a pawl detent recess 219, a collar 220 extending from a first collar end 221 to a second collar end 222 including a first collar aperture 223, a first interior collar sidewall 224, a collar wall aperture 226, an Interior collar wall 225, a second interior collar sidewall 228, and a second collar aperture 227, a head 230 extending from a first end 231 to a second end 232 and including a projection 216 recess and a textured pad portion 235, a pawl 240, a pawl detent spring 252, and a pawl detent 250.

It should be understood that each of these elements corresponds to and operates similarly to the plunger 110, the projection 116, the plunger extension 114, the plunger extension shoulder 115, the plunger body 111, the pawl detent recess 119, the collar 120, the first collar aperture 123, the first interior collar sidewall 124, the collar wall aperture 126, the Interior collar wall 125, the second interior collar sidewall 128, the second collar aperture 127, the head 130, the projection 116 recess, the textured pad portion 135, the pawl 140, the pawl detent spring 152, and the pawl detent 150, as described above with reference to the forward assist 100 of FIGS. 1-15.

However, as illustrated in FIGS. 16-27, an at least partially internally threaded projection aperture 217 extends from a terminal surface of the projection 216 toward the second end 213 of the plunger 210. A corresponding fastener aperture 237 is formed through an associated head 230. The fastener aperture 237 and projection aperture 217 are formed so as to be appropriately aligned when the head 230 is appropriately positioned relative to the plunger 210.

When the head 230 and plunger 210 are appropriately aligned, a portion of the head securing fastener 270 can be positioned through the fastener aperture 237 and secured, via interaction of the fastener head 272 of the head securing fastener 270 with the fastener aperture 237 and the internal threads of the projection aperture 217 with the external threads 275 of the head securing fastener 270 to further secure the head 230 to the plunger 210.

Figure 25:
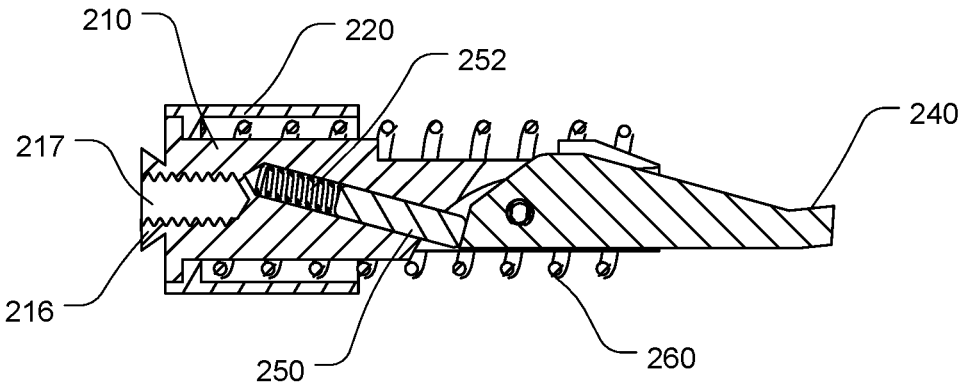
FIG. 25 illustrates a side, cross-sectional view of certain components of an exemplary embodiment of a partially assembled forward assist, according to the present disclosure.
Figure 26:
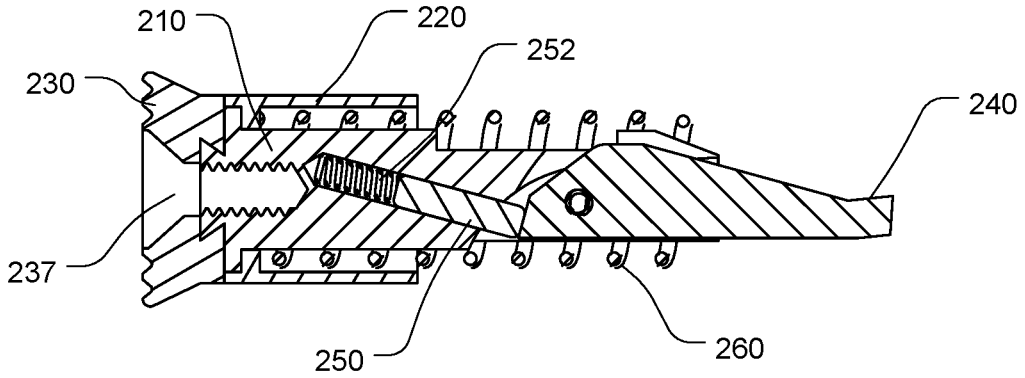
FIG. 26 illustrates a side, cross-sectional view of certain components of an exemplary embodiment of a partially assembled forward assist, wherein a head is in an installed position, according to the present disclosure.
Figure 27:
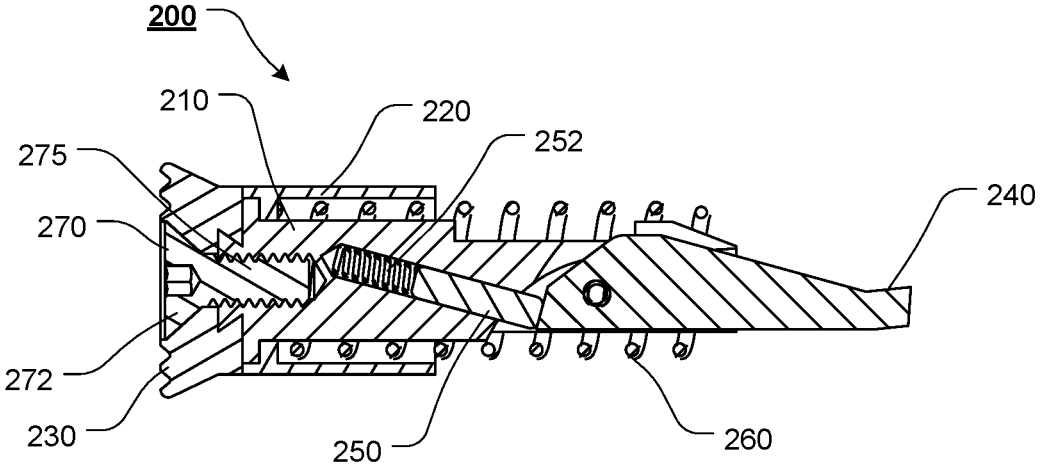
FIG. 27 illustrates a side, cross-sectional view of certain components of an exemplary embodiment of a partially assembled forward assist, wherein a head is in an installed position and a head securing fastener further secures the head to the plunger, according to the present disclosure.
Figure 28:
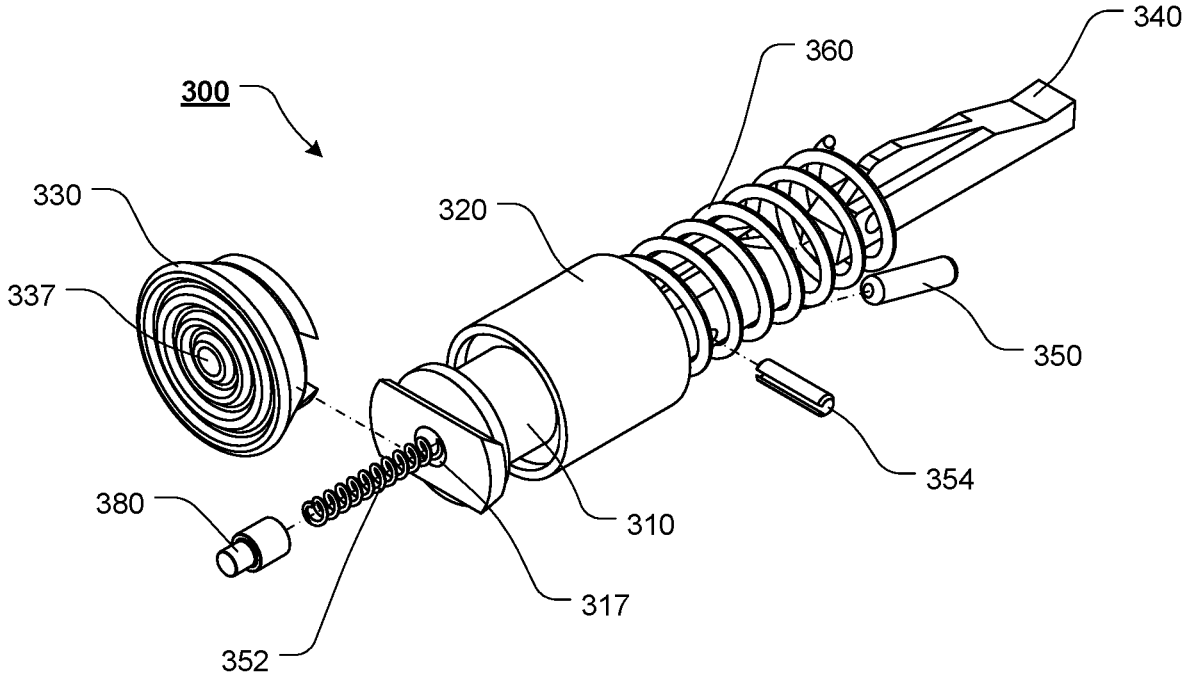
FIG. 28 illustrates an exploded view of certain components or elements of an exemplary embodiment of a forward assist, according to the present disclosure.
Figure 29:
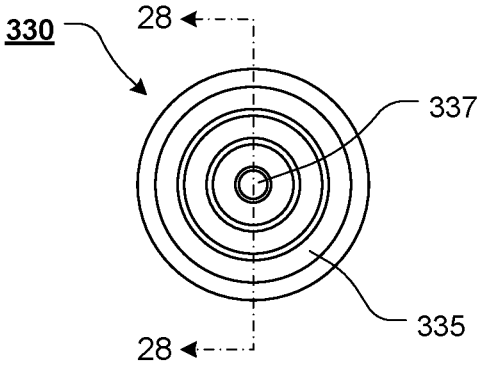
FIG. 29 illustrates a front view of an exemplary embodiment of an exemplary embodiment of a forward assist head, according to the present disclosure.
Figure 30:
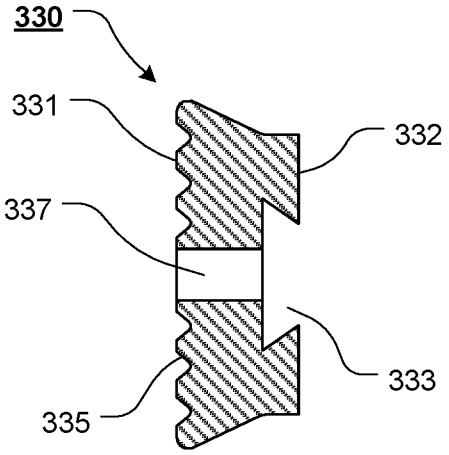
FIG. 30 illustrates a side, cross-sectional view of an exemplary embodiment of a forward assist head, according to the present disclosure.
Figure 31:
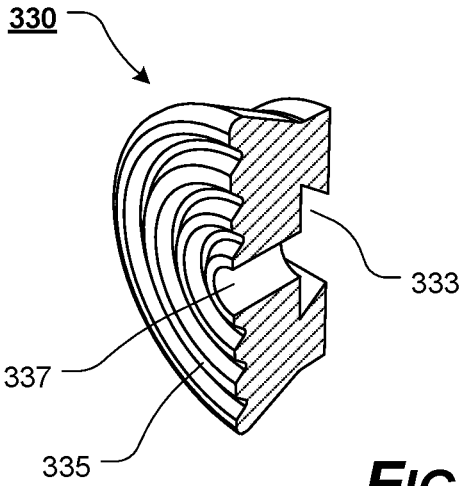
FIG. 31 illustrates a perspective, cross-sectional of an exemplary embodiment of a forward assist head, according to the present disclosure.
Figure 32:
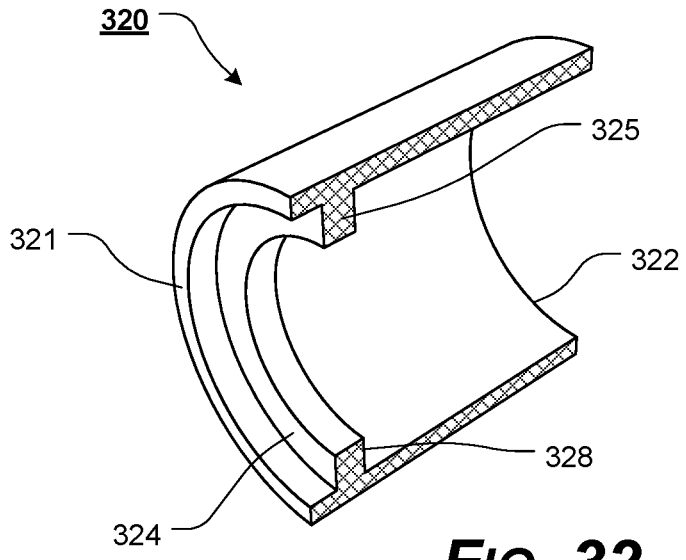
FIG. 32 illustrates a perspective, cross-sectional view of an exemplary embodiment of a collar, according to the present disclosure.
Figure 33:
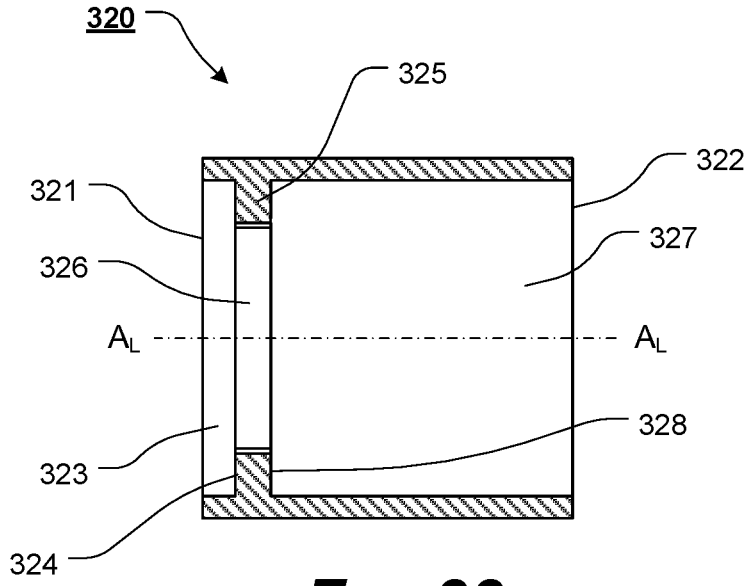
FIG. 33 illustrates a side, cross-sectional view of an exemplary embodiment of a collar, according to the present disclosure.
Figure 34:
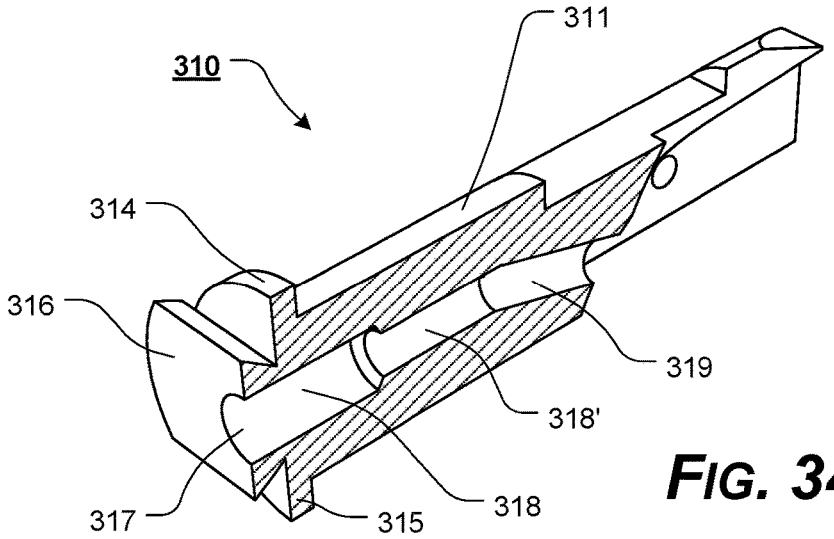
FIG. 34 illustrates a perspective, cross-sectional view of an exemplary embodiment of a plunger, according to the present disclosure.

In various exemplary embodiments, the head 230 includes a collar recess portion 239, such that the collar 220 can operate to further secure the head 230 to the plunger 210. Alternatively, as illustrated, at least a portion of the first collar end 221 may be formed so as not to interfere with movement of the head 230 relative to the plunger 210, when the collar 220 is in the engaged or locked position, as illustrated in FIGS. 25-27.

FIGS. 28-38, illustrate certain elements and/or aspects of an exemplary embodiment of a forward assist 300, according to the presently disclosed systems, methods, and/or apparatuses. As illustrated in FIGS. 28-38, the forward assist 300 comprises at least some of a plunger 310 extending from a first end 312 to a second end 313 and including a projection 316, a plunger extension 314, a plunger extension shoulder 315, a plunger body 311, and a pawl detent recess 319, a collar 320 extending from a first collar end 321 to a second collar end 322 including a first collar aperture 323, a first interior collar sidewall 324, a collar wall aperture 326, an Interior collar wall 325, a second interior collar sidewall 328, and a second collar aperture 327, a head 330 extending from a first end 331 to a second end 332 and including a projection 316 recess and a textured pad portion 335, a pawl 340, and a pawl detent 350.

It should be understood that each of these elements corresponds to and operates similarly to the plunger 110, the projection 116, the plunger extension 114, the plunger extension shoulder 115, the plunger body 111, the pawl detent recess 119, the collar 120, the first collar aperture 123, the first interior collar sidewall 124, the collar wall aperture 126, the interior collar wall 125, the second interior collar sidewall 128, the second collar aperture 127, the head 130, the projection 116 recess, the textured pad portion 135, the pawl 140, the pawl detent spring 152, and the pawl detent 150, as described above with reference to the forward assist 100 of FIGS. 1-15.

However, as illustrated in FIGS. 28-38, a detent/detent spring recess 317 (including a detent portion 318 and a detent spring portion 318') extends from a terminal surface of the projection 316, toward the second end 313 of the plunger 310. The detent/detent spring recess 317 extends to join the pawl detent recess 319. Thus, a head retaining detent/pawl detent spring 352 can be positioned within the detent spring portion 318' of the detent/detent spring recess 317 to replace the pawl detent spring 352 and bias the pawl 340.

A head retaining detent 380 is repeatably slidably positioned within the detent portion 318 of the detent/detent spring recess 317. Once so positioned, the head retaining detent/pawl detent spring 352 contacts the head retaining detent 380 to bias the head retaining detent 380 to an engaged or locked position, as illustrated in FIGS. 36 and 38.

A corresponding detent aperture 337 is formed through an associated head 330. The detent aperture 337 and detent/detent spring recess 317 are formed so as to be appropriately aligned when the head 330 is appropriately positioned relative to the plunger 310.

Figure 37:
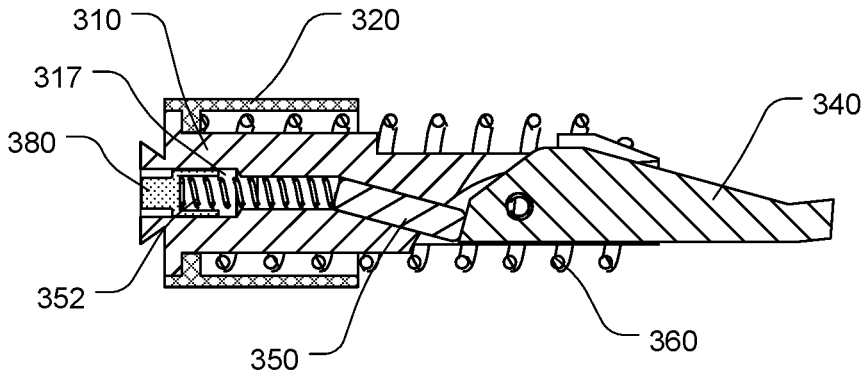
FIG. 37 illustrates a side, cross-sectional view of certain components of an exemplary embodiment of a partially assembled forward assist, wherein a head retaining detent is in a retracted or disengaged position, according to the present disclosure.

To install the head 330, the head retaining detent 380 is urged into the detent/detent spring recess 317 a sufficient distance, so that a terminal surface of the head retaining detent 380 is at least flush with a terminal surface of the projection 316. Once the head retaining detent 380 has been urged a sufficient distance into the detent/detent spring recess 317, as illustrated in FIG. 37, the head 330 can be slidably positioned relative to the plunger 310, via interaction of the projection 316 and head recess 333.

Figure 35:
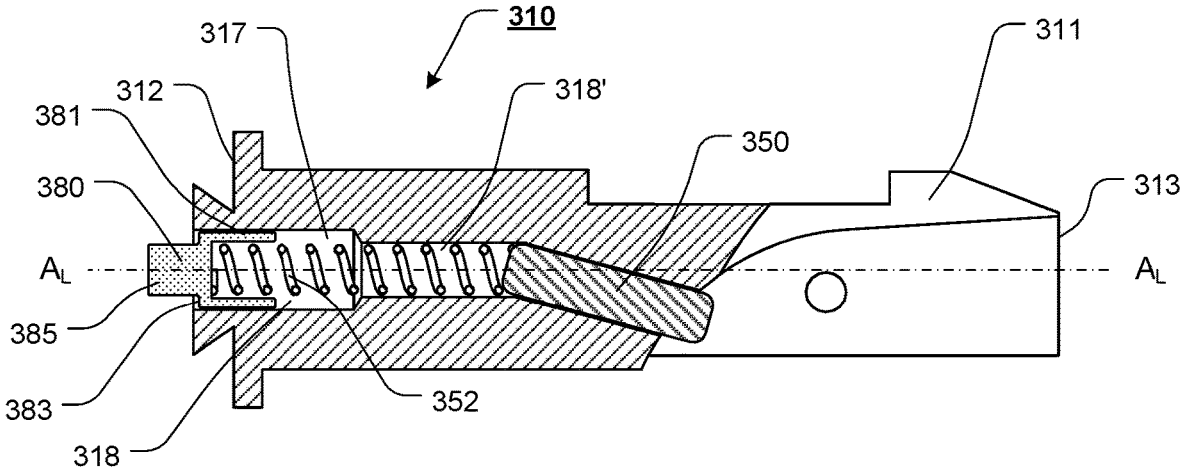
FIG. 35 illustrates a side, cross-sectional view of an exemplary embodiment of a plunger, according to the present disclosure.
Figure 36:
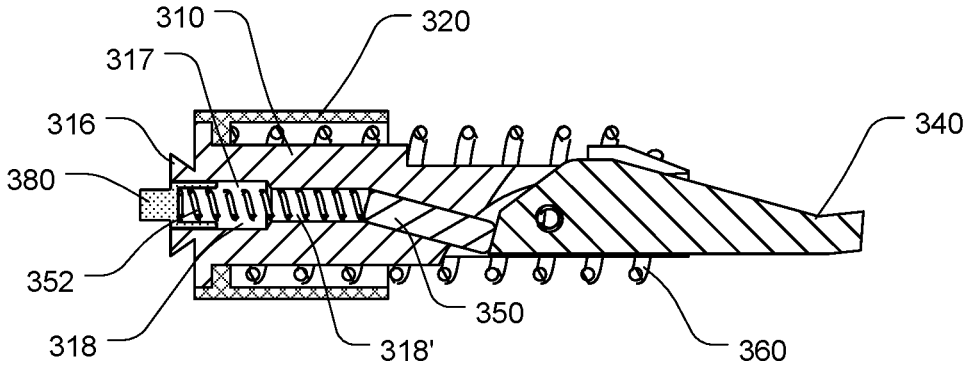
FIG. 36 illustrates a side, cross-sectional view of certain components of an exemplary embodiment of a partially assembled forward assist, wherein a head retaining detent is in an extended or engaged position, according to the present disclosure.
Figure 38:
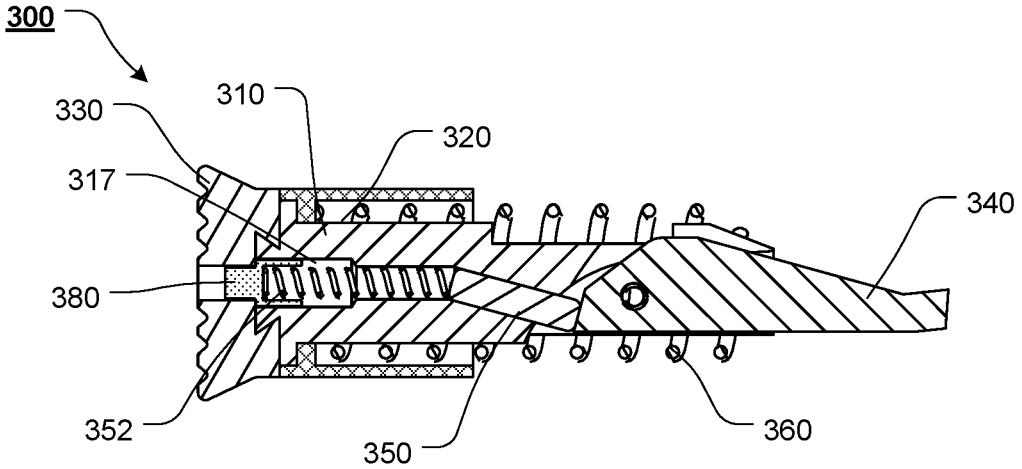
FIG. 38 illustrates a side, cross-sectional view of certain components of an exemplary embodiment of a partially assembled forward assist, wherein a head is in an installed position, wherein a head retaining detent is in an extended or engaged position to further secure the head to the plunger, according to the present disclosure.

When the head 330 and plunger 310 are appropriately aligned, the spring bias of the head 330 securing detent urges the head 330 securing detent to a locked or engaged position, as illustrated in FIGS. 35, 36, and 38.

The head retaining detent 380 extends from a body portion 381 to an extension portion 385. The body portion 381 includes an outer diameter that is greater than an outer diameter of the extension portion 385 and a detent shoulder 383 separates the body portion 381 from the extension portion 385. The detent aperture 337 of the head 330 includes a diameter that allows at least a portion of the extension portion 385 to pass at least partially therethrough, but does not allow the detent shoulder 383 or the body portion 381 to pass therethrough. Thus, in the locked or engaged position, the extension portion 385 extends into the detent aperture 337 of the head 330, to further secure the head 330 to the plunger 310.

In various exemplary embodiments, the head 330 includes a collar recess portion 339, such that the collar 320 can operate to further secure the head 330 to the plunger 310. Alternatively, as illustrated, at least a portion of the first collar 320 and may be formed so as not to interfere with movement of the head 330 relative to the plunger 310, when the collar 320 is in the engaged or locked position, as illustrated in FIGS. 36-38.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "the", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A forward assist, comprising:

a plunger having a projection extending from a first end of said plunger;

a partially rotatable, spring biased pawl extending from a portion of said plunger;

at least one head having a head recess formed in at least a portion of said head, wherein said head recess is mateable with said projection of said plunger, and wherein said head is secured to said first end of said plunger via interaction of said projection and said head recess; and a collar, wherein said collar is biased to cover at least a portion of said plunger and a portion of said head when said collar is in an engaged position and wherein said collar does not cover a collar recess portion formed in said head when said collar is in a disengaged position.

2. The forward assist of claim 1, wherein said projection of said plunger is a dovetail projection.

3. The forward assist of claim 1, wherein said head recess in said head is a dovetail recess.

4. The forward assist of claim 1, wherein said head recess extends through opposing sides of said head.

5. The forward assist of claim 1, wherein said head recess extends through at least a portion of said head.

6. The forward assist of claim 1, wherein said head is further secured to said projection of said plunger via a head retaining screw attaching or coupling said head to said plunger.

7. The forward assist of claim 1, wherein said head is further secured to said projection of said plunger via a spring biased detent extending from said plunger at least partially into said head.

8. A forward assist, comprising:

a plunger;

a partially rotatable, spring biased pawl extending from a portion of said plunger;

a projection extending from a first end of said plunger;

at least one head having a head recess formed in at least a portion of said head, wherein said head recess is mateable with said projection of said plunger, and wherein said head is secured to said first end of said plunger via interaction of said projection and said head recess; and a collar, wherein said collar is slidably positioned relative to said plunger, wherein said collar is spring biased to cover at least a portion of said plunger and a portion of said head when said collar is in an engaged position, and wherein said collar does not cover a portion of said head when said collar is in a disengaged position.

9. The forward assist of claim 8, wherein said projection of said plunger is a dovetail projection.

10. The forward assist of claim 8, wherein said head recess in said head is a dovetail recess.

11. The forward assist of claim 8, wherein said head recess extends through opposing sides of said head.

12. The forward assist of claim 8, wherein said head is further secured to said projection of said plunger via a head retaining screw attaching or coupling said head to said plunger.

13. The forward assist of claim 8, wherein said head is further secured to said projection of said plunger via a spring biased detent extending from said plunger at least partially into said head.

14. A forward assist, comprising:

a plunger having a projection extending from a first end of said plunger;

a partially rotatable, spring biased pawl extending from a portion of said plunger;

a head having a first end and a second end, wherein a head recess is formed in said first end of said head, wherein said projection is mateable with said head recess, and wherein said head is secured to said first end of said plunger via interaction of said head recess and said projection; and a collar, wherein said collar is slidably positioned relative to said plunger, wherein said collar is spring biased to cover at least a portion of said projection and a portion of said head recess when said collar is in an engaged position, and wherein said collar does not cover a portion of said head recess when said collar is in a disengaged position.

15. The forward assist of claim 14, wherein said head recess extends through opposing sides of said plunger.

16. The forward assist of claim 14, wherein when said collar is in a disengaged position, said collar does not cover a collar recess portion formed in said head.

* * * * *